US005702277A

United States Patent [19]

Wagner

[11] Patent Number: 5,702,277

[45] Date of Patent: *Dec. 30, 1997

[54] HIGH PERFORMANCE SWIM FIN

[76] Inventor: John Lee Wagner, 6185 Kimberly Dr., La Mesa, Calif. 91942

[ * ] Notice: The term of this patent shall not extend beyond the expiration date of Pat. No. 5,387,145.

[21] Appl. No.: 630,200

[22] Filed: Apr. 10, 1996

Related U.S. Application Data

[63] Continuation-in-part of Ser. No. 291,685, Aug. 17, 1994, abandoned, which is a continuation-in-part of Ser. No. 88,515, Jul. 7, 1993, Pat. No. 5,387,145.

[51] Int. Cl.[6] ..... A63B 31/08

[52] U.S. Cl. ..... 441/64

[58] Field of Search ..... 441/62–64; D21/239

[56] References Cited

U.S. PATENT DOCUMENTS

| | | | |
|---|---|---|---|
| 3,019,458 | 2/1962 | De Barbieri et al. | 441/64 |
| 3,055,023 | 9/1962 | Ferraro | 441/64 |
| 3,183,529 | 5/1965 | Beuchat | 441/64 |
| 3,422,470 | 1/1969 | Mares | 441/64 |
| 3,649,979 | 3/1972 | Mac Niel | 441/64 |
| 3,908,213 | 9/1975 | Hill | 441/64 |
| 3,913,158 | 10/1975 | Vilarrubis | 441/64 |
| 3,922,741 | 12/1975 | Semela | 441/64 |
| 4,083,071 | 4/1978 | Foriot | 441/64 |
| 4,627,820 | 12/1986 | Penebre | 441/64 |
| 4,775,343 | 10/1988 | Lamont et al. | 441/64 |
| 5,259,798 | 11/1993 | Runckel | 441/64 |
| 5,387,145 | 2/1995 | Wagner | 441/64 |

*Primary Examiner*—Ed L. Swinehart

[57] ABSTRACT

A foot mounted fin for use by body surfers, divers, and swimmers in water activities of all types. The strap of the swim fin fits around the ankle while the fin blade extends out beyond the foot. There is a scoop section designed to take in water at the top of the fin near the foot. Scoop discharge ports for discharging water is at the blade tip. The scoop section also channels the water to eyelet ports formed into the fin blade, enabling it to discharge water out and over the bottom surface of the fin blade while at the same time releasing it at the blade tip. This combines the forces of the two jet streams of water. This fin works with wave turbulence and ocean currents enabling the body surfer, diver and/or swimmer to fully utilize the power potential from the ocean on his/her behalf. This fin also includes side rib extensions to increase blade width and surface area without making it too long. In addition this fin may also come with an adjustable foot chamber, and/or foot chamber lining, and/or adjustable ankle strap to maximize comfort and fit while at the same time enabling one pair of fins to fit a variation of foot sizes.

11 Claims, 8 Drawing Sheets

FIG. 8A
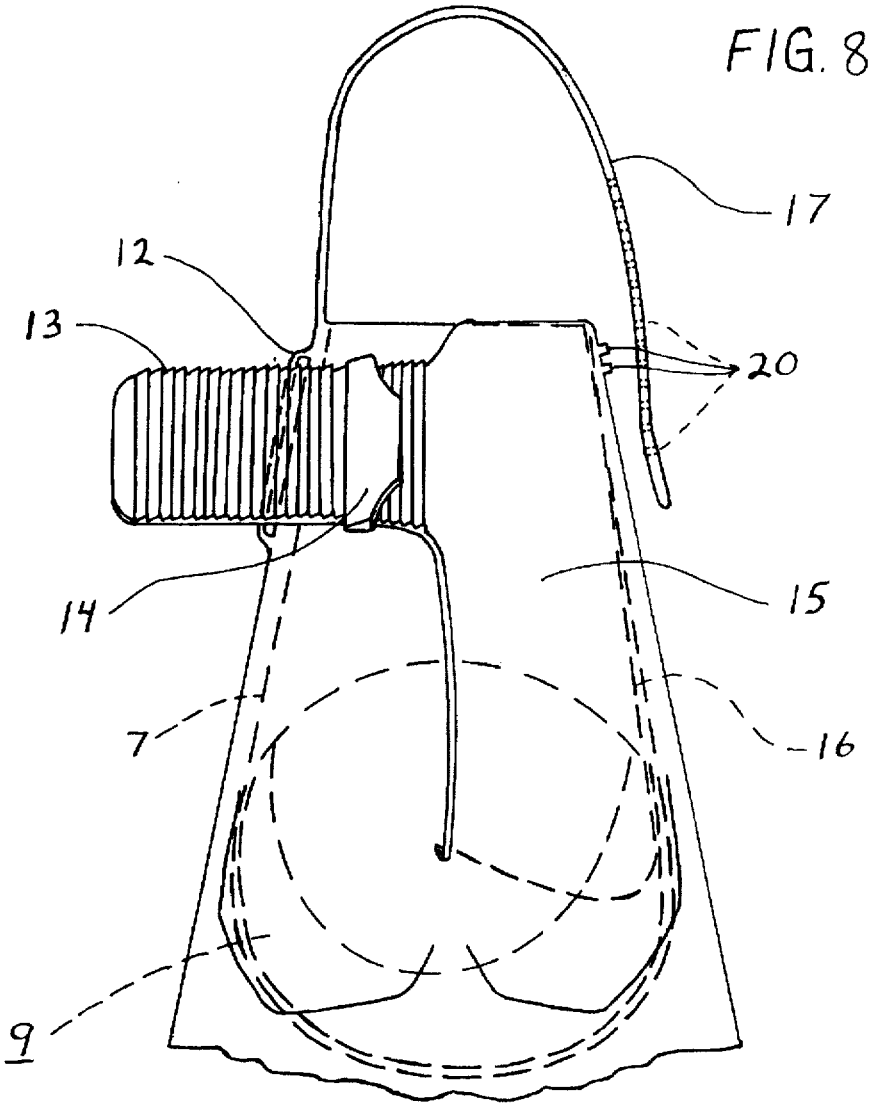
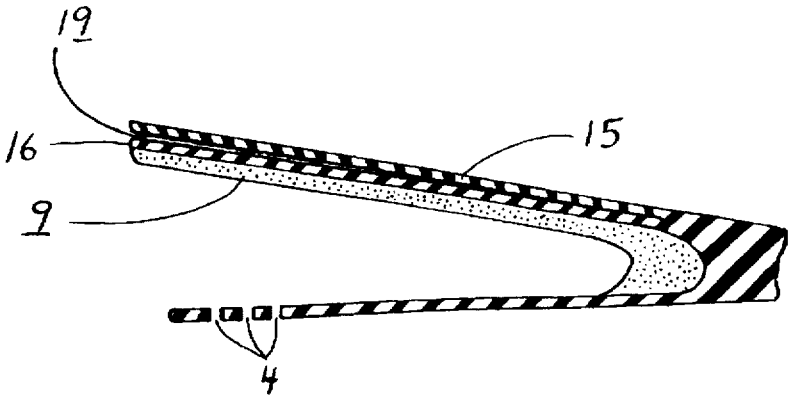
FIG. 8B

HIGH PERFORMANCE SWIM FIN

This application is a continuation in-part of U.S. patent application Ser. No. 291,685, filed Aug. 17, 1994 now abandoned, which is a continuation in part of Ser. No. 08/088,515, filed Jul. 7, 1993, U.S. Pat. No. 5,387,145.

Field of Invention

This invention relates to swim fins, a foot-mounted fin for use by body surfers and other swimmers and divers.

Background of the Invention

Swim fins are designed to increase the swimmers mobility and speed in the water while at the same time reducing the amount of energy required to be expended.

Originally swim fins were designed to mimic the fins or flippers of aquatic animals. They were generally made of a solid piece of rubber or plastic that contained some means of attachment to the foot. While these designs did increase the power of the swimmer's thrusting motion, they did not maximize the hydrodynamic principles involved.

Later designs such as U.S. Pat. No. 3,649,979 to Mac Niel (1972), U.S. Pat. No. 3,913,158 to Vilarrubis (1970), U.S. Pat. No. 4,083,071 to Forjot (1978) and U.S. Pat. No. 4,627,820 to Penebre (1985) included different types of "scoop" portions to take in water, allowing it to pass through the fin and be released at the tip of the fin or close to it. Although this is an improvement, it still does not provide for efficient channeling of the water to the back side or bottom surface of the fin while at the same time releasing it at the tip. This flaw prevents the swimmer from fully utilizing the power potential of the water flow over the surface area of the fin.

U.S. Pat. Nos. 3,183,529 to Beuchat (1965), 3,055,025 to Ferraro (1962), 3,422,470 to Mares (1967), 3,922,741 to Semela (1974) and 4,775,343 to Lamont and Chapelas (1988) are designed to channel water to the back side or bottom of the fin. However, without a specialized portion of the fin to actively direct the water to the channels, these designs fail to deliver the maximum use of water power to the swimmer. Also, some of these types of fins are too big and bulky for effective use by swimmers and body surfers.

U.S. Pat. No. 3,908,213 to Hill (1975) shows a soft insert that lines the entire foot chamber. Although this protects the wearer's foot, it results in decreased leverage on the dorsal or bottom of the foot chamber and therefore decreases the amount of thrust obtained through each kick.

All of the swim fins previously known suffer from a number of disadvantages:

(a) Previous designs fail to channel the water effectively and therefore do not maximize the effect of the water flow over the entire available surface of the fin.

(b) Many previous designs are too big and bulky, reducing the swimmer's mobility in the water and requiring unneeded expenditures of energy.

(c) Some designs are too short, failing to provide maximum stroke efficiency in the water.

(d) Some designs are too complex, resulting in a cumbersome device that defeats the basic purpose of the fin by decreasing mobility and agility in the water.

(e) Some fins are designed to be used exclusively by divers while others can be used only by swimmers, necessitating buying different fins for each activity.

(f) Most previous designs do not provide any means for reducing the natural friction that occurs between the user's foot and the fin which can cause abrasions along the wearer's toes and foot. The ones that do provide protection do so at the expense of fin leverage and efficiency.

SUMMARY OF THE INVENTION

The objects and advantages of the present invention include, but are not limited to:

(a) The addition of a scoop or bridge portion across the top part of the fin forces the water through the main body of the fin and releases water at the tip of the blade portion and at the same time guides water to the eyelet channels to be released out the dorsal or bottom surface area of the swim fin. This design makes the optimum use of the flow of water by directing jet streams of water over all surfaces of the fin, giving the swimmer increased power with each kick stroke. At the same time, the fin reduces the amount of energy output required by the user.

(b) Having the water intakes further down the face of the fin and further away from the foot portion results in increasing the amount/volume of water the fin is able to take in, and discharge at the tip of the fin blade.

(c) Extending the scoop or bridge portion past the main body of the fin has the effect of combining the force of the jet stream of water from the eyelet channels with the jet streams of water from the bridge or scoop, thereby increasing the amount of energy released at the tip of the fin blade.

(d) Eyelet channels formed into the main body of the fin just below the foot area and traveling towards the tip of the fin in a row on both sides of the center rib increase the efficiency of the fin by utilizing the flow of water or ocean current and directing it to the back surface of the fin.

(e) The seventeen embodiments of this fin can be designed in different lengths and widths, enabling the swimmer or diver to choose which style would most improve his/her agility in the water.

(f) The special lining of the ventral or upper half of the foot chamber with a soft, flexible material acts as a cushion and reduces friction along the swimmer's foot thereby resulting in a more comfortable fit and eliminating abrasions caused by friction with the stiffer blade material. This is accomplished without loss of efficiency because the dorsal or bottom half of the foot chamber is unlined, providing a solid foundation for leverage. This may also serve as an adjustable foot pocket lining for smaller or larger feet.

(g) An extra strip of flexible material has been added to each side rib and can be angled upwardly towards the top (ventral blade) surface or angled downwardly towards the dorsal blade surface. This results in increased blade surface and power output of the fin without having to make the fin blade longer and more cumbersome, thereby keeping the amount of energy necessary to move through the water at a minimum. By increasing blade surface in this manner without lengthening the fin blade, less damage to delicate underwater ecosystems is caused than that of longer, more cumbersome fins.

(h) This design offers all of the advantages of a complex system in a streamlined package.

(i) The addition of two over lapping layers of adjustable flaps of material with an adjustable latching device in the foot chamber, allows the user to get an exact fit while at the same time one pair of fins is able to fit a variation of foot sizes thereby making it possible for fins to have an adjustable foot pocket.

BRIEF DESCRIPTION OF THE DRAWINGS

In the drawings, closely related figures have the same number but different alphabetic suffixes.

FIG. 8A shows a top view of the fins adjustable foot chamber with an adjustable foot chamber strap and latching device along with an adjustable ankle strap and partial adjustable foot chamber lining;

FIG. 8B shows a cross sectional view of FIG. 8C adjustable foot chamber and foot chamber lining length ways;

Reference Numerals In Drawings

Figure 1A:
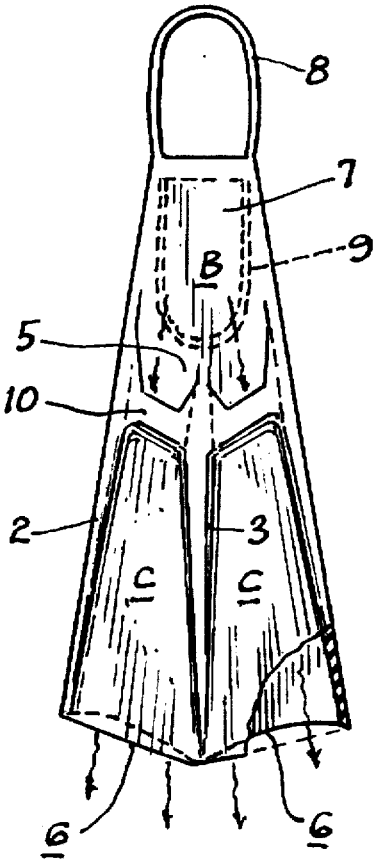
FIGS. 1A and 1B show the top view of the fin including the water scoop portion that is affixed to the top of the blade, and shows where the water will be drawn in just below the foot and discharged at the blade tip.

A blade portion
B foot portion
C scoop portion
1 eyelet channels
2 side ribs
3 center rib
4 sand escape ports
5 water scoop intake ports
6 water scoop discharge ports
7 foot chamber
8 ankle strap
9 interchangeable size foot chamber lining
10 scoop bevel
11 side rib extensions
12 excess adjustable foot chamber strap retainer
13 adjustable foot chamber strap
14 adjustable foot chamber strap latching device
15 overlapping adjustable foot chamber joinable flap
16 underside adjustable foot chamber joinable flap
17 adjustable ankle strap
18 pull tab
19 strapless adjustable latching system
20 adjustable ankle strap latching system

DETAILED DESCRIPTION OF PREFERRED EMBODIMENTS

Referring to FIGS. 1A, 1B, 1C, 1E, 2A, 2B, 2C, 2E, 3A, 3B, 3C, 3E, 4A, 4E, 8A, 8B, 8C, and 8D, the High Performance Swim Fin is generally comprised of a blade portion A, a foot portion B, and a water-scoop portion C. In the preferred embodiment, the entire swim fin is made in one continuous piece and is composed of rubber, polyurethane, or any suitable flexible material. This design can also be made from two or more different materials fused together; the blade being made of one flexible material and the scoop portion composed of a different flexible material.

Figure 5:
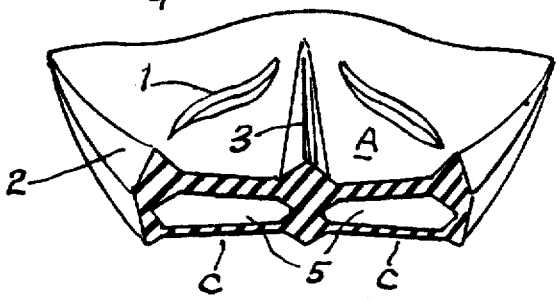
FIG. 5 shows a cross section bottom view of the blade portion with the eyelet channels, side and center ribs, how the water scoop portion goes across the blade and the contour of the water scoop intake ports.

The blade A is composed of a solid piece of rubber, polyurethane or any suitable flexible material with sufficient shore hardness. The blade houses a foot portion B, eyelet channels 1, and supports the scoop portion C. The blade tapers down towards the tip of the fin. The blade has side and center ribs for extra support. The side rib sections 2 run parallel along the outer edges of the blade portion. Side rib extensions 11 consist of thin strips of added material angled upwardly towards the ventral side of the fin blade and scoop section or angled downwardly towards the dorsal side of the fin blade and eyelet channels to increase the overall blade width. The center rib 3 travels down the center line of the fin, beginning at about the center of the foot section and extending toward the tip of the blade. The eyelet channels 1 are cut into the blade portion indicated in FIG. 2A, FIG. 2B and FIG. 5 at an appropriate angle. This design can accommodate two eyelet channels or more, positioned in rows on both sides of the center rib. Sand escape ports 4 are formed into the blade at the foot chamber 7.

Figure 3A:
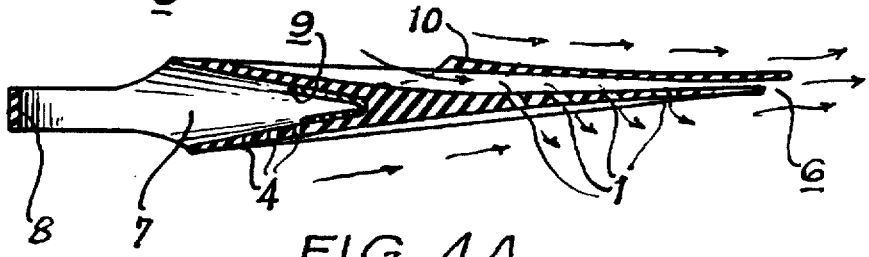
FIGS. 3A and 3B show side views of the fin, indicating the approximate angle the eyelet channels are set into the fin blade, the formation of the foot chamber, location of the sand escape ports, and the relation of the water scoop portion to the blade.
Figure 4A:
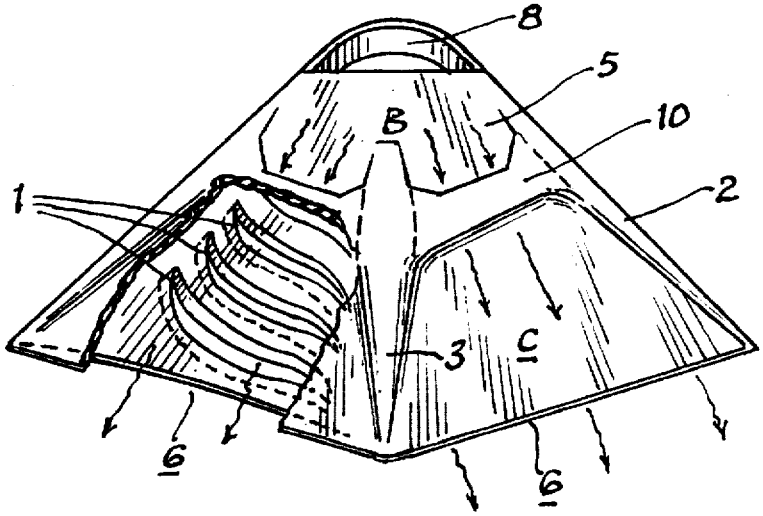
FIG. 4A is a front view of the fin demonstrating the flow of water through the fin and how the scoop portion could be extended beyond the blade tip.
Figure 1B:
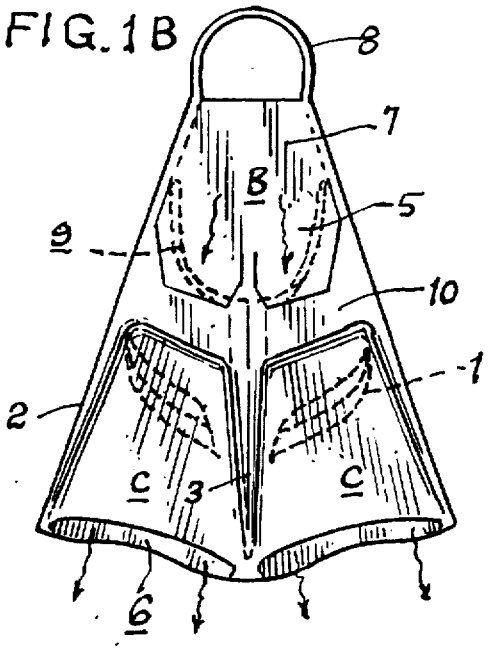
Figure 2B:
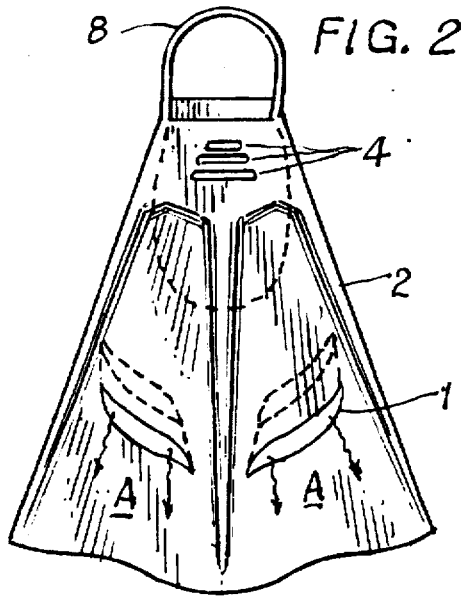
Figure 3B:
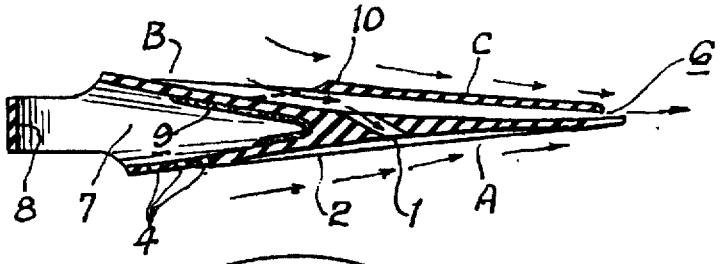
Figure 1C:
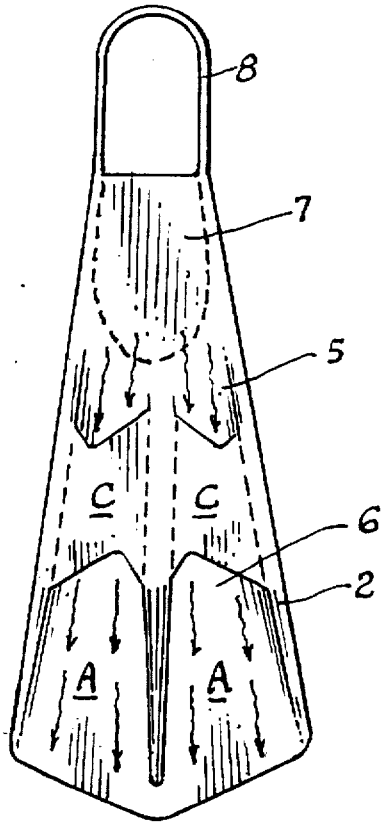
FIG. 1C shows the top view of the fin with the water scoop recessed back from the blade tip.
Figure 2C:
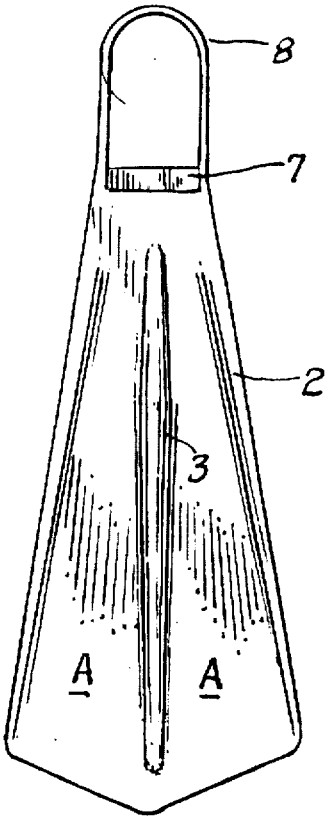
FIG. 2C shows the bottom view of the fin with the side and center ribs, but without the eyelet channels.
Figure 3C:
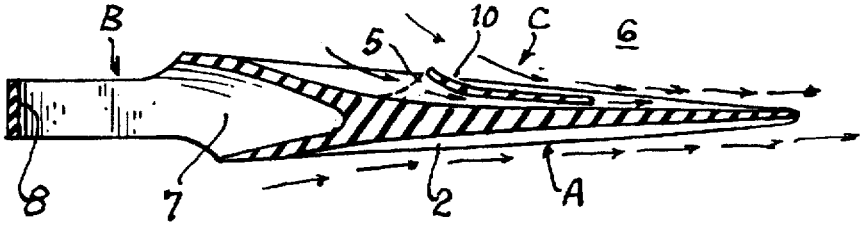
FIG. 3C shows the side view of the fin with a recessed water scoop portion and without eyelet channels.
Figure 4B:
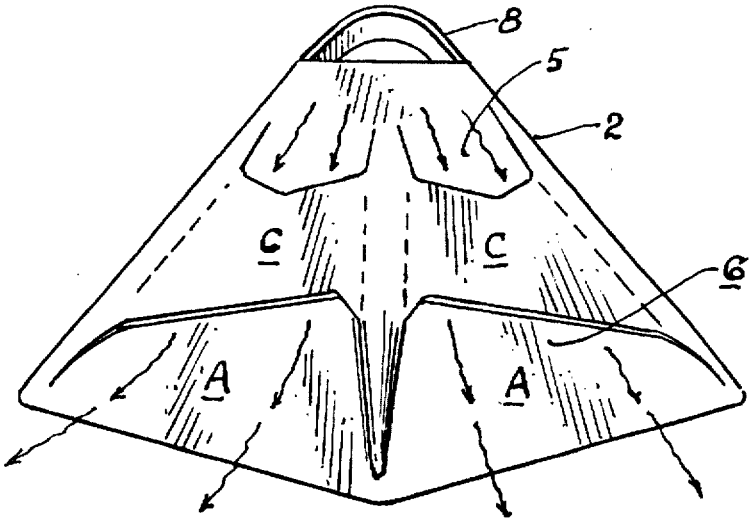
FIG. 4B is a front view of the fin showing the scoop portion dramatically recessed back from the blade tip.
Figure 1D:
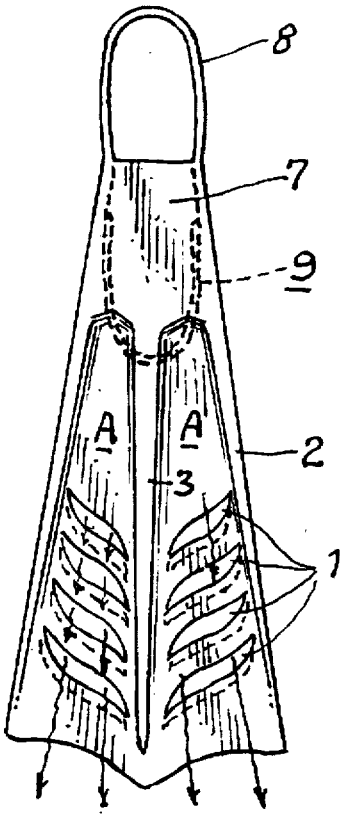
FIG. 1D shows the top view of the fin without a water scoop portion but having eyelet channels.
Figure 2D:
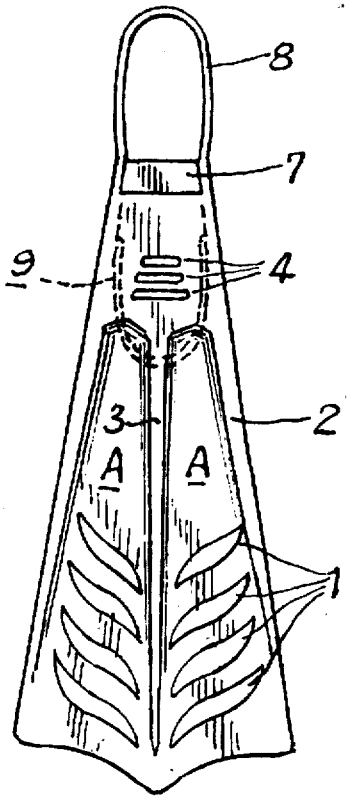
Figure 3D:
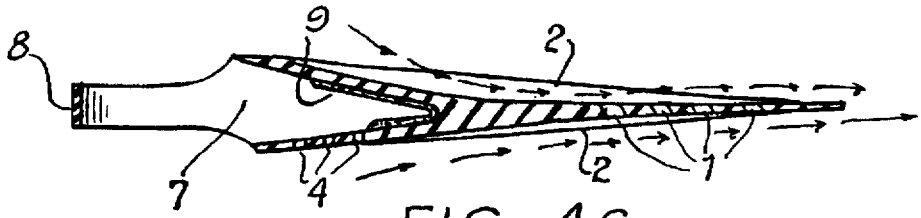
FIG. 3D shows a side view of the fin without a water scoop portion.
Figure 4C:
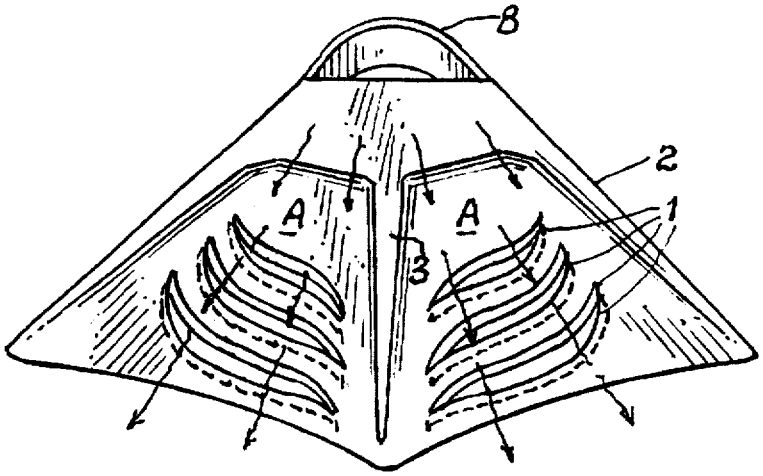
FIG. 4C is a front view of the fin without the water scoop portion showing the eyelet channels.
Figure 1E:
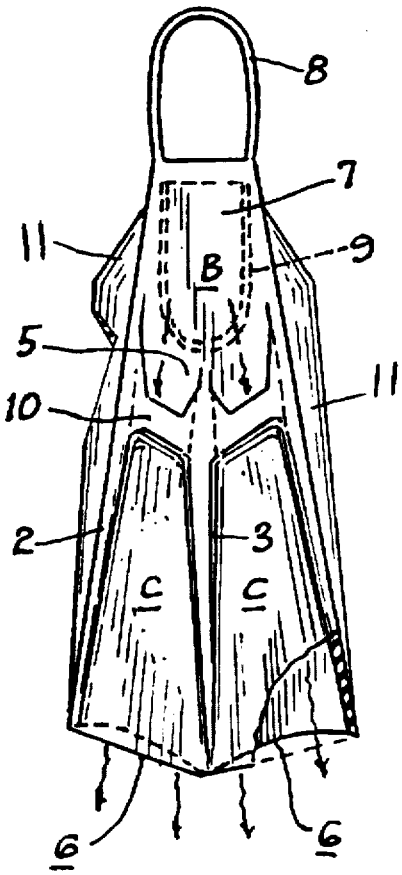
FIG. 1E shows all of the above and a top view of the side rib extensions.
Figure 2E:
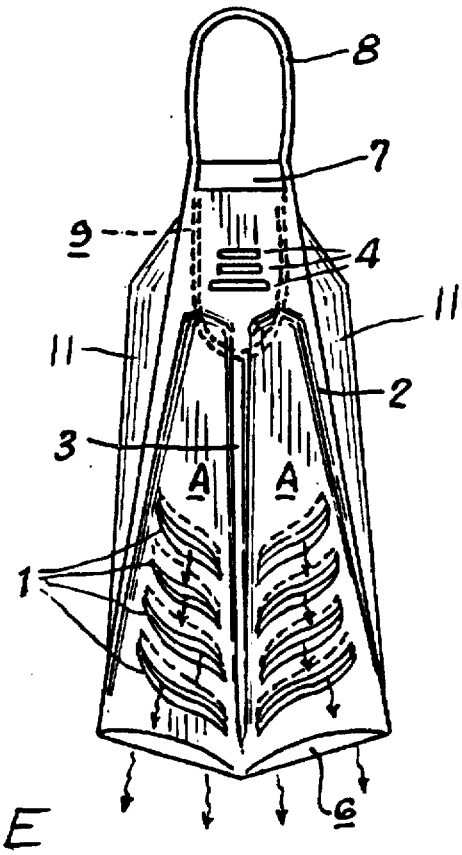
FIG. 2E shows all of the above and the bottom view of the side rib extensions.
Figure 3E:
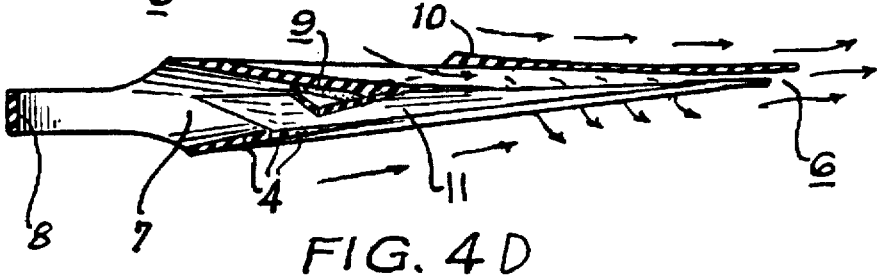
FIG. 3E shows all of the above and the side view of the side rib extensions.
Figure 4D:
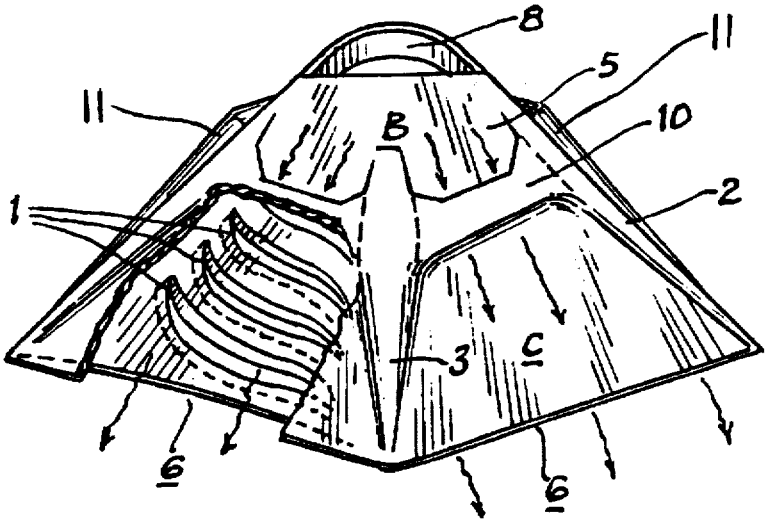
FIG. 4D is a front view of the fin with the scoop portion extended beyond the blade tip and the addition of the side rib extensions.

The water scoop portion C starts at the base of the foot chamber 7, extends across the top of the fin and, depending on the model, either runs the full length of the blade, is recessed back from the tip of the blade as shown in FIG. 1C, FIG. 3C, and FIG. 4B, or may extend slightly beyond the blade tip. Illustrated, in FIG. 4E it is equally conceivable that the scoop section B may be formed on the dorsal side of the swim fin and the eyelet channels 1 can be formed on the ventral side of the swim fin. This would put the scoop section on the bottom of the fin blade. The eyelet channels would then be on top and used to draw in water and direct it into the scoop section basically turning this dual directional water channeling system upside down from what drawings 1A—4A and 1E—3E show. This may be added to any of the different embodiments of this fins design. This scoop section is joined at the side and center rib sections, having relatively large openings or water scoop intake ports 5 at the top of the blade directly following the foot chamber 7 and tapering to long, narrow openings at the tip of the blade, the water scoop discharge ports 6. The water scoop, as shown in FIG. 3C may be beveled 10 slightly upwardly at the water intake ports and at the side and center ribs. This is also shown in FIG. 1A, FIG. 1B, FIG. 1E, FIG. 3A, FIG. 3B, FIG. 3E, and FIG. 4A.

Figure 8C:
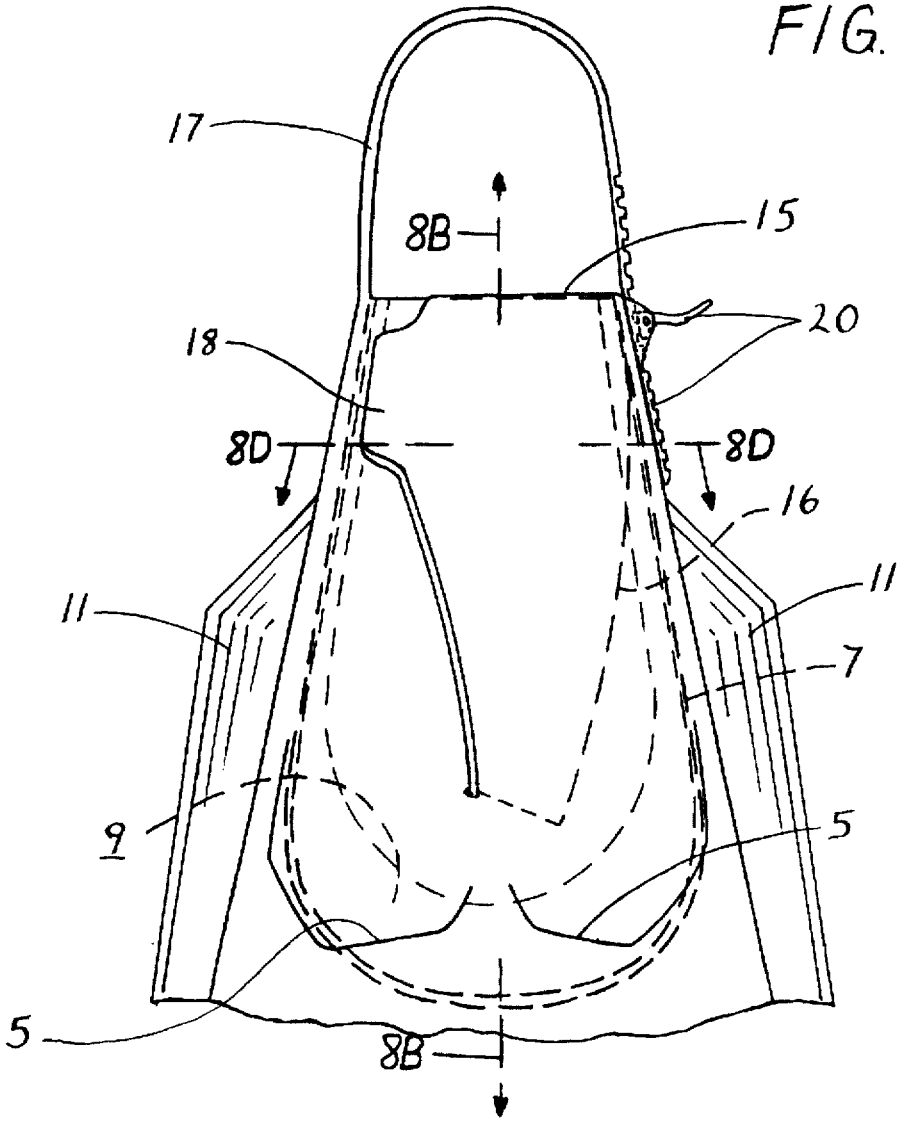
FIG. 8C shows a top view of the fins strapless adjustable foot chamber and adjustable ankle strap.
Figure 8D:
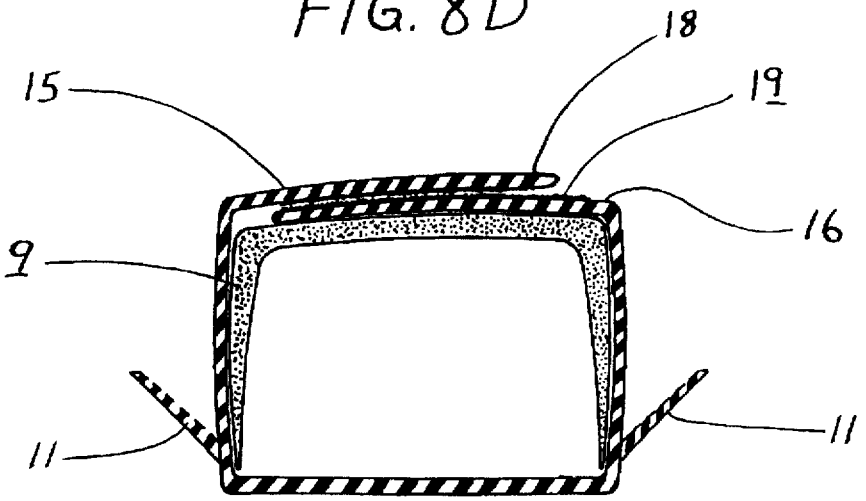
FIG. 8D shows a cross sectional view of FIG. 8C adjustable foot chamber from side to side along with a diagonal cut from top to bottom.

The foot portion B is comprised of a foot chamber 7 formed from the top, bottom and side walls of the blade portion. The foot chamber lining 9 is comprised of a softer flexible material. This may come in various sizes and may be slipped in or out of the foot chamber allowing for different size feet. This foot chamber may also come with two disconnecting and connecting, joinable layered flaps of material on the ventral or top side of the foot chamber allowing it to become wider or narrower, higher or lower depending on the width and height of the foot to be placed into the foot chamber as shown in FIGS. 8A–8D. Sand escapes ports 4 are formed in the bottom side of the foot chamber. A strap 8 made of one continuous piece of flexible material is formed from the blade of fin and is designed to go around the ankle of the swimmer. This design may also accommodate an adjustable strap as shown in FIGS. 8A and 8C. Additionally, the foot section can be made in different sizes.

This design can be made in many contemporary or translucent colors, including two or three toned colors, blending into one another or into clear or all clear.

Operation—FIGS. 1–8

FIGS. 1(A. . . E)–4(A. . . D) and FIGS. 5, 6, and 7 and 8 (A. . . D) demonstrate the operation of the High Performance Swim Fin by showing the way in which water flows through and over the fin during the swimmer's up and down strokes and some ways in which the adjustable foot chamber could be made to function.

On the swimmer's downstroke the water is drawn in at the water scoop intake ports 5. The water is then channeled through the tapered scoop section and released at the narrower openings at the tip of the blade, the water scoop discharge ports 6. This results in a form of jet-propulsion. The discharged water adds to the power to the thrust of the swimmer's downstroke. At the same time the water is forced through the eyelet channels 1, allowing the water to be channeled to the back surface of the fin on the swimmer's upstroke. The combination of the jet streams of water released at the water scoop discharge ports 6 and eyelet channels 1 increase the amount of thrust at the tip of the blade and give the swimmer maximum utilization of the water flow or ocean current on both up and down strokes. In addition to this, side rib extensions 11 have been added. These side rib extensions can be angled up or down towards the ventral or dorsal side of the fin blade depending on the fin style to be made. This helps to increase blade width and overall blade surface area without increasing the length of the blade. This would also aid in channeling water to increase thrust therefore increasing the amount of power delivered from each kick stroke and reduce, or do away with, damage to underwater ecosystems that longer fins can cause.

The foot chamber lining 9 in the foot chamber protects the swimmer's foot from abrasions caused by friction between the foot and the fin and results in added comfort and safety for the swimmer. In addition this may come in various lengths and widths and be slipped in or out of the foot chamber. This may also be used in combination with the two disconnecting and connecting layered flaps of material on the top side of the foot chamber, showing some of the ways in which the foot pocket could be made adjustable.

The High Performance Swim Fin of the present invention delivers maximum power to the swimmer, diver or bodysurfer who uses it. In addition it requires less expenditure of energy by the user. Furthermore, this swim fin has the additional advantages in that:

*it increases the amount of water flowing over the surface areas of the fin that results in added thrust

*it channels water to the back side of the fin thereby utilizing the top and bottom surface areas of the fin simultaneously

*it increases the user's mobility in the water

*it increases blade surface without increasing length

*it is a complex system in a streamlined design

*it increases the safety and comfort of the user by providing a cushioned foot chamber to overcome the natural friction between the foot and the fin

*it overcomes the limitations of previous designs

Figure 2A:
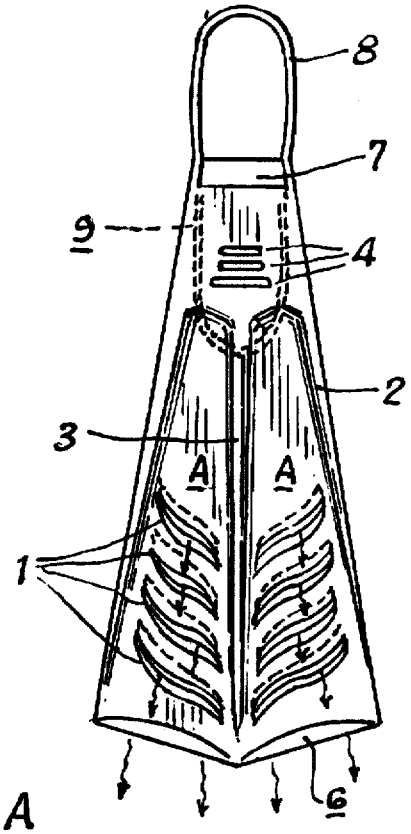
FIGS. 2A, 2B and 2D show the bottom view of the fin and how the eyelet channels could be shaped into the main body of the fin blade, and indicates the location of the side and center ribs, the foot chamber and the sand escape ports.
Figure 6:
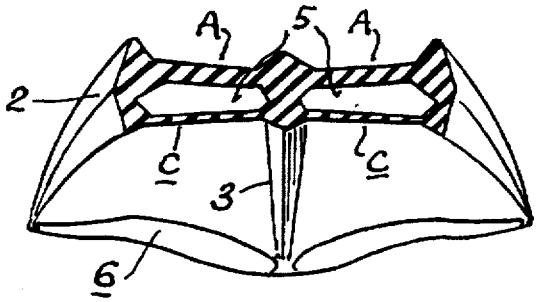
FIG. 6 shows a cross section top view of the blade portion and the water scoop portion, side and center ribs, and the contour of the water scoop intake ports.
Figure 7:
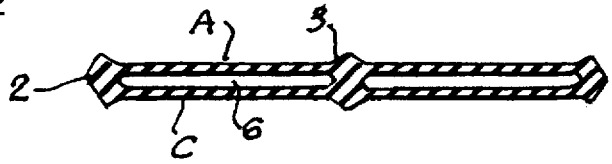
FIG. 7 shows a cross section view of the area where the blade portion and water scoop portion meet to form the water scoop discharge ports at the tip of the blade.
Figure 4E:
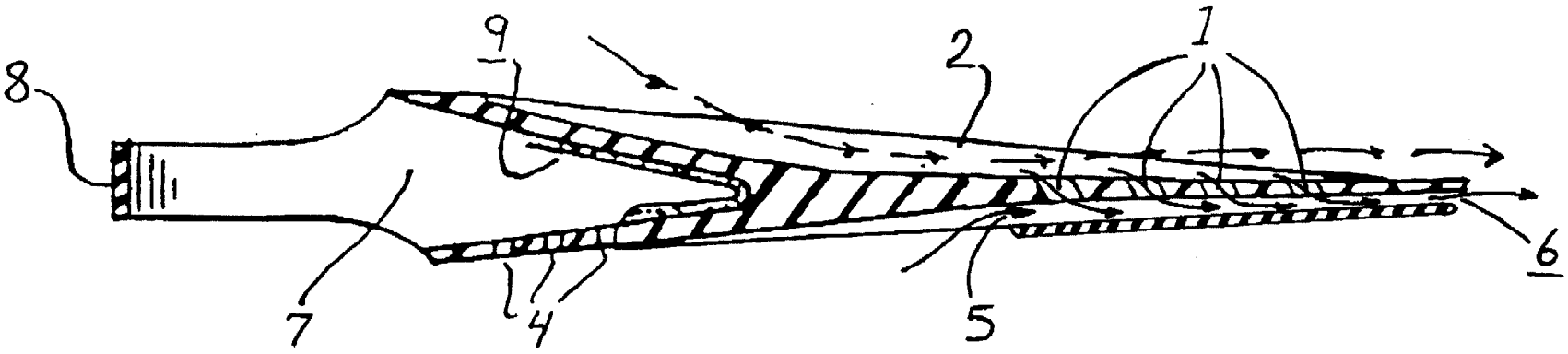
FIG. 4E shows a side cross sectional view of the fin but with the scoop section attached to the bottom or dorsal side of the fin blade.

Although the description above contains many specifications, these should not be construed as limiting the scope of the invention but as merely providing illustrations of some of the presently preferred embodiments of this invention. For example, the fin can be made with just the water scoop portion without the eyelet channels as shown in FIG. 1C, 2C, 4B and 3C, or can be made with just the eyelet channels without the scoop portion as shown in FIGS. 1D, 2D, 4C, and 3D. The water scoop portion can be dramatically recessed back from the tip of the blade as shown in FIGS. 1C, 4B, and 3C, or can be slightly recessed back from the tip of the blade as shown in FIGS. 1B, 3B and 6, or can extend slightly beyond the tip of the blade as shown in FIGS. 1A, 2A, 3A, 4A. The eyelet channels can vary in number from only two, as shown in FIGS. 1B, 2B, 3B and 5, or more as shown in FIGS. 2A, 4A, 3A. The fin can be made in a wide version or a long, narrow version. This fin can also be made with or without the side rib extensions angled to the ventral or dorsal side of the fin blade to increase blade width as shown in FIGS. 1E–4D. The fin can be made in two pieces, with the scoop comprised of one material, and the two fused together or the entire swim fin can be made in one continuous piece. The fin may also be made with the scoop section placed on the bottom or dorsal side of the fin with the eyelet channels on the top or ventral side of the fin. This would then utilize the eyelet channels for drawing in water and directing it into the scoop section basically turning this dual directional water channeling system upside down as shown in FIG. 4E. This fin may also be made with an adjustable foot chamber as shown in FIGS. 8A–8D or an adjustable foot chamber lining as shown in FIGS. 1A, 2A, 3A, 1B, 3B, 1D, 2D, 3D, and 8A–8D. Also the adjustable foot chamber and foot chamber lining may be used in combination with one another as shown in FIGS. 8A–8D. The fin may also be made with the scoop section placed on the bottom or (dorsal) side of the fin with the eyelet channels on the top or (ventral) side of the fin. This would then utilize the eyelet channels for drawing in water and directing it into the scoop section basically turning this dual directional water channeling system upside down as shown in FIG. 4E. This fin can be made in contemporary or neon colors or translucent colors, with two or three colors blending into one another or into clear, or all clear.

Thus the scope of the invention should be determined by the appended claims and their legal equivalents, rather than by the examples given. While the particular swim fin as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A foot-mounted swimming aid comprising:

a a hollow foot chamber open at the heel having an exterior surface of flexible material of sufficient size to accommodate a human foot and having a ventral lining of soft flexible material and having a series of elongated holes to vent the chamber;

b a blade portion of flexible material which can be relatively stiffer than the flexible material of said foot chamber and connects to said foot chamber and extends past the foot chamber and broadens and tapers outward toward the end forming a flexible triangular shaped web having thickened support areas along the sides and in the center to add support and tapering downwards towards the end and in between said thickened support areas hollowed-out sections in the shape of curved, elongated slots set at two different angles in the triangular web;

c a thin layer of flexible material extending from the beginning of the blade portion across the top of the blade generally to the end of the blade and connected to the blade at the thickened support areas creating openings between the side and center support areas and in between said thin layer that goes across the top of the blade portion thereby directing water to the elongated curved slots; and d a thin strip of added flexible material extending outwardly from each side of the thickened support areas, beginning adjacent to said foot chamber and continuing down each side of said thickened support areas towards the end of said triangular shaped web and can be angled toward the ventral side of said triangular web or toward the dorsal side of said triangular web.

2. The invention as claimed in claim 1, wherein said curved elongated slots can be cut or molded into the triangular web in rows on each side of the center thickened support area, set at a first angle to the center thickened support area and sloped toward the foot chamber at second angle.

3. The invention as claimed in claim 1, wherein said thin layer of flexible material extending across the top of the blade portion is joined at the side and center thickened support areas having relatively large openings at the top of the blade for the intake of water and tapering to long, narrow openings at the end of the blade.

4. The invention as claimed in claim 1, wherein said thin layer of flexible material extending across the top of the blade can be recessed back from the end of the blade.

5. The invention as claimed in claim 1, wherein said thin layer of flexible material extending across the top of the blade can extend slightly beyond the end of the blade.

6. The invention as claimed in claim 1, wherein the said thin layer of flexible material extending across the top of the blade creates trapezoidal shaped openings near the foot chamber for the intake of water and triangular shaped openings at the blade end for the release of water.

7. The invention as claimed in claim 1, wherein said thin strip of flexible material extending outwardly from each side of the thickened support areas forms long, narrow triangular shapes and can be angled up and outward toward the ventral side of the blade or angled down and outward toward the dorsal side of the blade to increase the blade width.

8. The invention as claimed in claim 1, wherein said foot chamber lining of soft flexible material, may come in different foot sizes to accommodate or assist in the accommodation of an adjustable foot chamber allowing for the various sizes of feet, this could come in different heights, widths, and lengths.

9. The invention as claimed in claim 1, wherein said foot chamber may have an opening an the ventral or top part of the foot chamber with two overlapping layered flaps of material with adjustable securing or fastening device allowing the foot chamber to become adjustable in height and width, to accommodate and fit securely around feet of different proportions.

10. The invention as claimed in claim 1, wherein said hollow foot chamber may be equipped with an adjustable ankle strap and/or foot chamber lining allowing for adjustments for different foot lengths.

11. A foot-mounted swimming aid comprising:

a a hollow foot chamber open at the heel having an exterior surface of flexible material of sufficient size to accommodate a human foot and having a ventral lining of soft flexible material and having a series of elongated holes to vent the chamber;

b a blade portion of flexible material which can be relatively stiffer than the flexible material of said foot chamber and connects to said foot chamber and extends past the foot chamber and broadens and tapers outward toward the end forming a flexible triangular shaped web having thickened support areas along the sides and in the center to add support and tapering downwards towards the end, and in between said thickened support areas hollowed-out sections in the shape of curved, elongated slots set at two different angles in the triangular web;

c a thin layer of flexible material extending across the bottom of the blade portion generally to the end of the blade portion and connected to the blade portion at the thickened support areas creating openings between the side and center support areas and in between said thin layer that extends across the bottom of the blade portion; and d a thin strip of added flexible material extending outwardly from each side of said thickened support areas, beginning adjacent to said foot chamber and continuing down each side of said triangular shaped web and can be angled toward the ventral side of said triangular web or toward the dorsal side of said triangular web.

* * * * *